US009821328B2

(12) United States Patent
Lo

(10) Patent No.: US 9,821,328 B2
(45) Date of Patent: Nov. 21, 2017

(54) SPRINKLER

(71) Applicant: YUAN-MEI CORP., Changhua County (TW)

(72) Inventor: Shun-Nan Lo, Changhua County (TW)

(73) Assignee: YUAN-MEI CORP., Changhua (TW)

( * ) Notice: Subject to any disclaimer, the term of this patent is extended or adjusted under 35 U.S.C. 154(b) by 533 days.

(21) Appl. No.: 14/196,000

(22) Filed: Mar. 4, 2014

(65) Prior Publication Data

US 2015/0251197 A1 Sep. 10, 2015

(51) Int. Cl.

*B05B 1/32* (2006.01)
*B05B 1/30* (2006.01)
*B05B 1/28* (2006.01)

(52) U.S. Cl.

CPC ..... *B05B 1/30* (2013.01); *B05B 1/28* (2013.01); *B05B 1/3026* (2013.01)

(58) Field of Classification Search

CPC ..... B05B 1/30; B05B 1/28; B05B 1/3026
USPC ..... 239/457
See application file for complete search history.

(56) References Cited

U.S. PATENT DOCUMENTS 3,944,138 A * 3/1976 Easton ..... B05B 1/14 239/18
6,435,427 B1 * 8/2002 Conroy ..... B05B 1/1654 239/392
8,006,919 B2 * 8/2011 Renquist ..... B05B 3/0422 239/206
2002/0139868 A1 * 10/2002 Sesser ..... B05B 1/262 239/457
2008/0169363 A1 * 7/2008 Walker ..... B05B 1/14 239/457
2009/0140076 A1 * 6/2009 Cordua ..... B05B 1/3026 239/457
2010/0090024 A1 * 4/2010 Hunnicutt ..... B05B 3/003 239/204
2010/0301142 A1 * 12/2010 Hunnicutt ..... B05B 1/304 239/457

* cited by examiner

*Primary Examiner* — Christopher Kim
*Assistant Examiner* — Adam J Rogers
(74) *Attorney, Agent, or Firm* — Raymond Y. Chen; David and Raymond Patent Firm

(57) ABSTRACT

A sprinkler with adjustable fan angle of water sprayed is revealed. The adjustable fan angle of water sprayed means a fan area of the water sprayed is adjusted and changed. The sprinkler includes a housing, a receiving seat and a sprinkler head. The sprinkler head consists of a base seat, a collar member and an adjustment member. The fan angle of the water sprayed can be manually operated and changed by rotating the adjustment member.

21 Claims, 10 Drawing Sheets

SPRINKLER

BACKGROUND OF THE INVENTION

Fields of the Invention

The present invention relates to a sprinkler, especially to a sprinkler inserted into or mounted on the ground surface for spraying water to a fan shaped area and adjusting water dispersed mode.

Descriptions of Related Art

Refer to U.S. Pat. No. 4,579,285, U.S. Pat. No. 5,205,491, U.S. Pat. No. 5,556,036, U.S. Pat. No. 6,443,372, and U.S. Pat. No. 6,769,633, sprinklers with adjustable outflow are revealed. Generally, the sprinkler includes a housing having one end with an opening and a sprinkler head having an outlet on the housing. The end of the housing with the opening is connected to a water source. A plurality of insertion holes is formed on top surface of a hollow housing and a middle seat with a threaded hole is formed on a center of the housing. The insertion holes are communicating with inner space of the housing. The sprinkler head is connected to and fixed on the housing. The sprinkler head includes an upper cover and a lower cover. An end surface of the upper cover and an end surface of the lower cover are conical. A helical surface is formed on the conical portion. A drop between end points of the helical surfaces is used as a stopper. The upper cover and the lower cover are disposed with a threaded hole respectively. A threaded rod is inserted through the threaded holes to be connected to and mounted in the housing. When the upper cover of the sprinkler is rotated and moved to the end point of the lower cover, the helical surface of the upper cover closes the outlet of the lower cover. At the same time, the two stoppers on the helical surfaces designed at corresponding positions are also leaning against and stopping each other. Due to closing of the outlet by the upper cover, water entering from a bottom end of the housing flows through each insertion hole is unable to be sprayed. This is "non-spray" state. Once the upper cover is rotated in opposite direction, the outlet of the lower cover is opened and a fan angle of the water sprayed can be changed.

Refer to U.S. Pat. No. 6,769,633, a 360-degree sprinkler head is disclosed. The sprinkler head includes a main member, an adjustment ring, a cap and a lock bolt. The sprinkler features on that the main member is a hollow cylinder having an annular member positioned at a center thereof with a plurality of coupling tabs connected to the hollow cylinder and a stepped edge arranged at an upper end of the hollow cylinder. The adjustment ring has a plurality of coupling tines along its lower side conjoined to a round nut constituting a stepped annular member, a helical rib proceeding around the surface opening at the upper end of the annular member, and a beveled surface articulated as an outlet along the inner edge of the helical rib. The cap is a funnel-shaped cover member consisting of a threaded section and a spigot tube sequentially formed at the middle lower section. A passage is passed through the center of the entire cover member, and a plurality of slots disposed at intervals in the outer wall of the spigot tube, with a lip formed along the outer periphery of the spigot tube. The adjustment ring is placed onto said stepped edge of the main member and then the threaded section of the cap is fastened into the round nut on the adjustment ring so that said spigot tube at a lower end of the threaded section is inserted into the annular member of the main member and the lip on the spigot tube engages the lower end surface of the annular member. Thus the main member, the adjustment ring and the cap are integrated into a single unit. Finally the lock bolt is inserted upward through a lower extent of the main member and fastened into the passage to prevent the contraction and upward dislodging of the spigot tube.

However, in the above prior arts, the inner diameter of the lower cap and the diameter of the outlet of the water channel are the same. In other words, the outflow pressure is directly released from the water channel. The outflow pressure is not distributed evenly by the water channel and the amount of water sprayed within the fan angle is not dispersed evenly. Moreover, the width of the circular outflow gap formed by extension of helical surfaces of the upper cap and the lower cap is different. Thus the fan-shaped water spray generated can be powerful or weak.

In order to avoid such condition, the helical surface of the upper cover and the helical surface of the lower cover are disposed with a tooth-like or step-like member respectively. The fan-shaped spray is dispersed evenly by the tooth-like or step-like member. Yet another problem is raised. When curvature of a helical surface of the upper cover and curvature of a helical surface of the lower cover are mot matched well, the two helical surfaces are unable to leaning against each other tightly. Thus the sprinkler is unable to be closed completely and water may leak. Refer to U.S. Pat. No. 6,443,372, an adjustable sprinkler nozzle is revealed. The adjustable sprinkler nozzle includes a cap with a first spiraling face, the bottom edge of which is provided with a stepped flange. A body that forms a nozzle orifice with the cap is composed of upper and lower bodies coupled together. The cap further includes a bottom end thereof and a cylindrical tube positioned at a bottom end of the cap. The cylindrical tube has a threaded outer surface forming a threaded member threadingly coupled with a threaded portion of the lower body. A third spiraling face is formed in proximity to an upper end face of the upper body and is corresponding to the second spiraling face and having an inner diameter engaging with outer diameter of the stepped projecting flange of the cap. Furthermore, a longitudinal drop face formed between the high and low planes of the third spiraling face is provided with a first stop piece projecting upwardly from a highest point thereof. The stop piece is inwardly provided with an inclined face. The inner wall surface of the third spiraling face is provided with a second stop piece relative to the position of the first stop piece. The inner tubular wall of said upper body is provided with a positioning projecting block located at a predetermined position of the inner tubular wall. The adjustable sprinkler nozzle features on that the cap with a first spiraling face, the bottom edge of which is provided with a stepped flange. The inner diameter of the third spiraling face can just be fitted into by the larger outer diameter of the stepped flange of the cap for stopping water flow and prevent water flow from leaking. However, the close fitting between the larger outer diameter of the stepped flange and the third spiraling face may cause difficulties in rotation while adjusting the sprinkler nozzle.

SUMMARY OF THE INVENTION

Therefore it is a primary object of the present invention to provide a sprinkler that overcomes the problem of uneven spray area and enables water outflow dispersed within adjustable spray angle more even.

In order to achieve the above object, a sprinkler of the present invention includes a base and a sprinkler head disposed over the base. The base consists of a receiving seat, a first seal ring, a housing and a second seal ring. The sprinkler head is connected to the receiving seat. The sprinkler head is composed of a base seat, a collar member, a third seal ring, an adjustment member, a fastener, and a cap.

The collar member 22 is disposed with a first stopping wall, a second stopping wall and a groove. An end surface of the first stopping wall is a conical helical surface. An end surface of the second stopping wall is also a conical helical surface corresponding to the conical helical surface of the first stopping wall. The first stopping wall is around the collar member while the second stopping wall is arranged inside the first stopping wall. One end surface of the second stopping wall is disposed with a lug whose shape is an inclined surface and the inclined height thereof is higher than that of the conical helical surface of the second stopping wall. A first water channel and a helical rib are formed due to the second stopping wall. The helical rib is wound around an inner diameter of the second stopping wall. The groove is arranged at a bottom surface of a connecting portion located between the first stopping wall and the second stopping wall of the collar member. The bottom surface of the groove is flat.

The adjustment member includes a control part, a leaning part, and an assembly part. The leaning part consists of a first against surface, a second against surface and a third against surface. The first against surface is a conical helical surface. The leaning part is extended from the control part and the assembly part is arranged with a through hole whose inner surface is disposed with internal threads. The second against surface is corresponding to the conical helical surface of the second stopping wall while the third against surface is corresponding to the helical rib. The maximum diameter of the second against surface is just matched the diameter of the first water channel of the collar member so as to adjust or close outflow of the first water channel.

The first against surface of the adjustment member is a conical helical surface spiraling from a lower position to an upper position. The shape of the first against surface matches the shape of the conical helical surface of the first stopping wall and the shape of the inclined lug. The lug is leaning against the first against surface of the adjustment member, used as a dividing wall. An outflow gap is formed by rotating the adjustment member. When the adjustment member is rotated, a radial width of the outflow gap is increased or decreased so as to change the fan angle of the water sprayed.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein:

FIG. 8-1 is a partial enlarged view of the embodiment in FIG. 8;

DETAILED DESCRIPTION OF THE PREFERRED EMBODIMENT

In order to allow people skilled in the related arts may make and use the invention, following embodiments are used together with the figures to describe the present invention in details.

Figure 6:
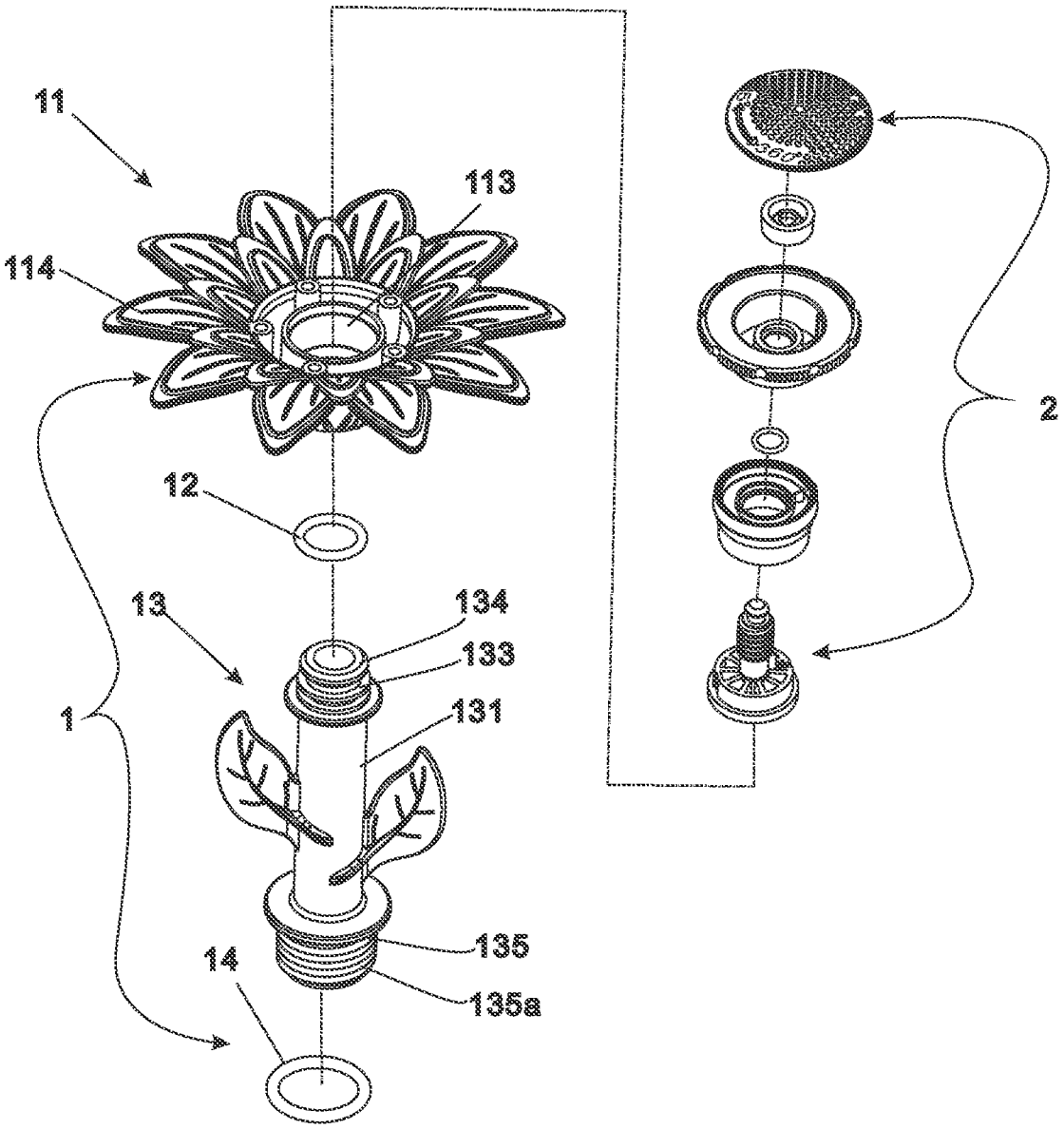
FIG. 6 is an explosive view of an embodiment according to the present invention.
Figure 7:
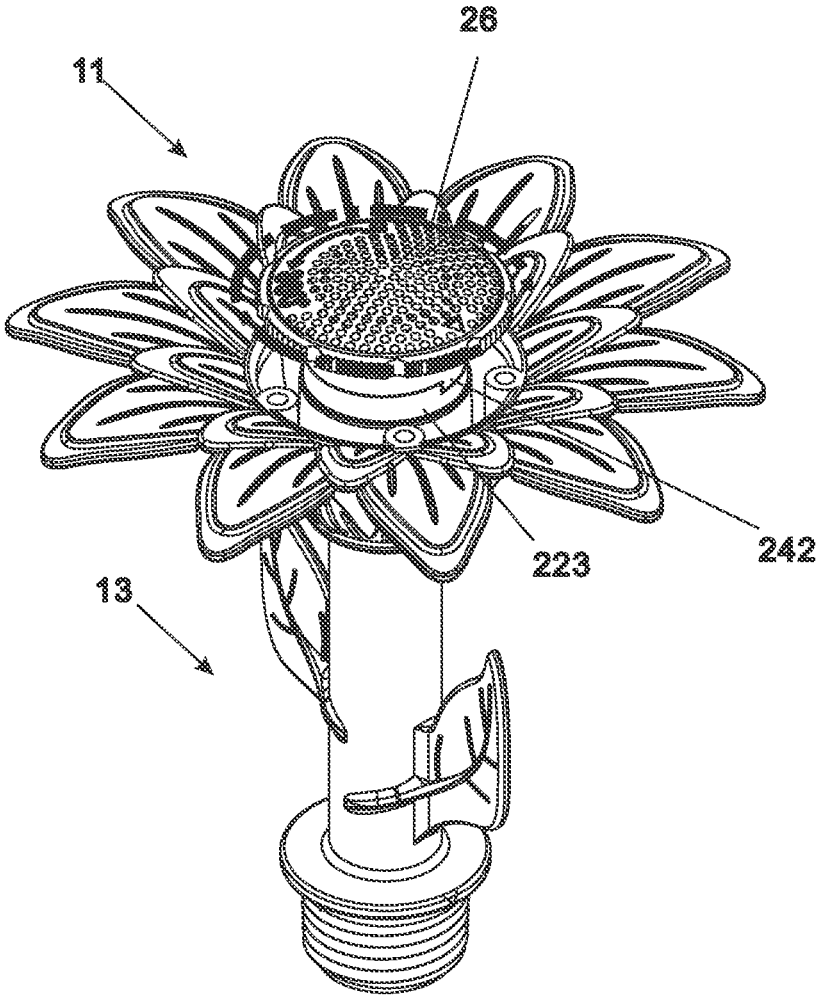
FIG. 7 is a perspective view of an embodiment according to the present invention.

Refer from FIG. 6, a sprinkler of the present invention includes a base 1 and a sprinkler head 2 disposed over the base 1. The base 1 consists of a receiving seat 11, a first seal ring 12, a housing 13 and a second seal ring 14. The sprinkler head 2 is connected to the receiving seat 11.

Figure 1:
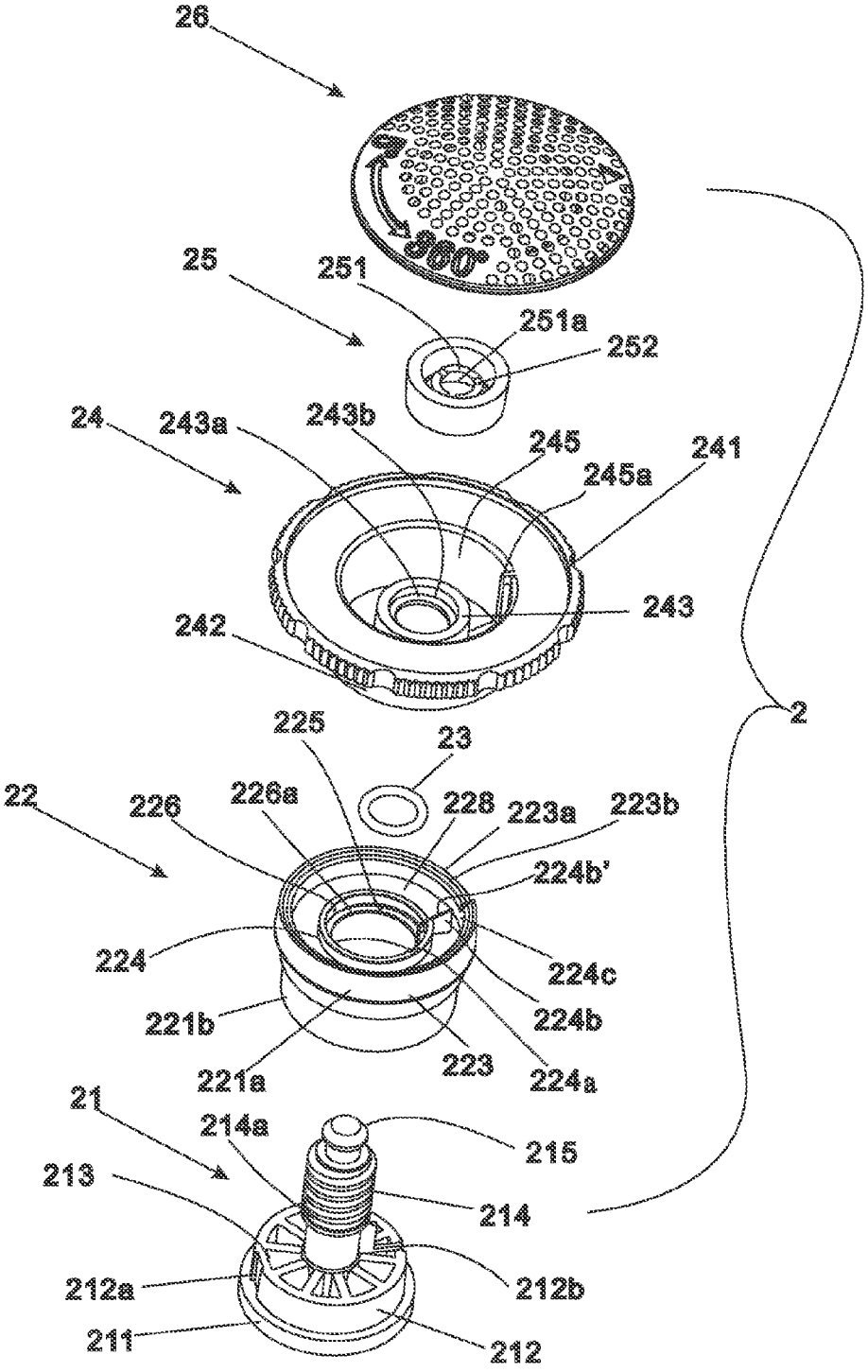
FIG. 1 is an explosive view of a sprinkler head of an embodiment according to the present invention.
Figure 2:
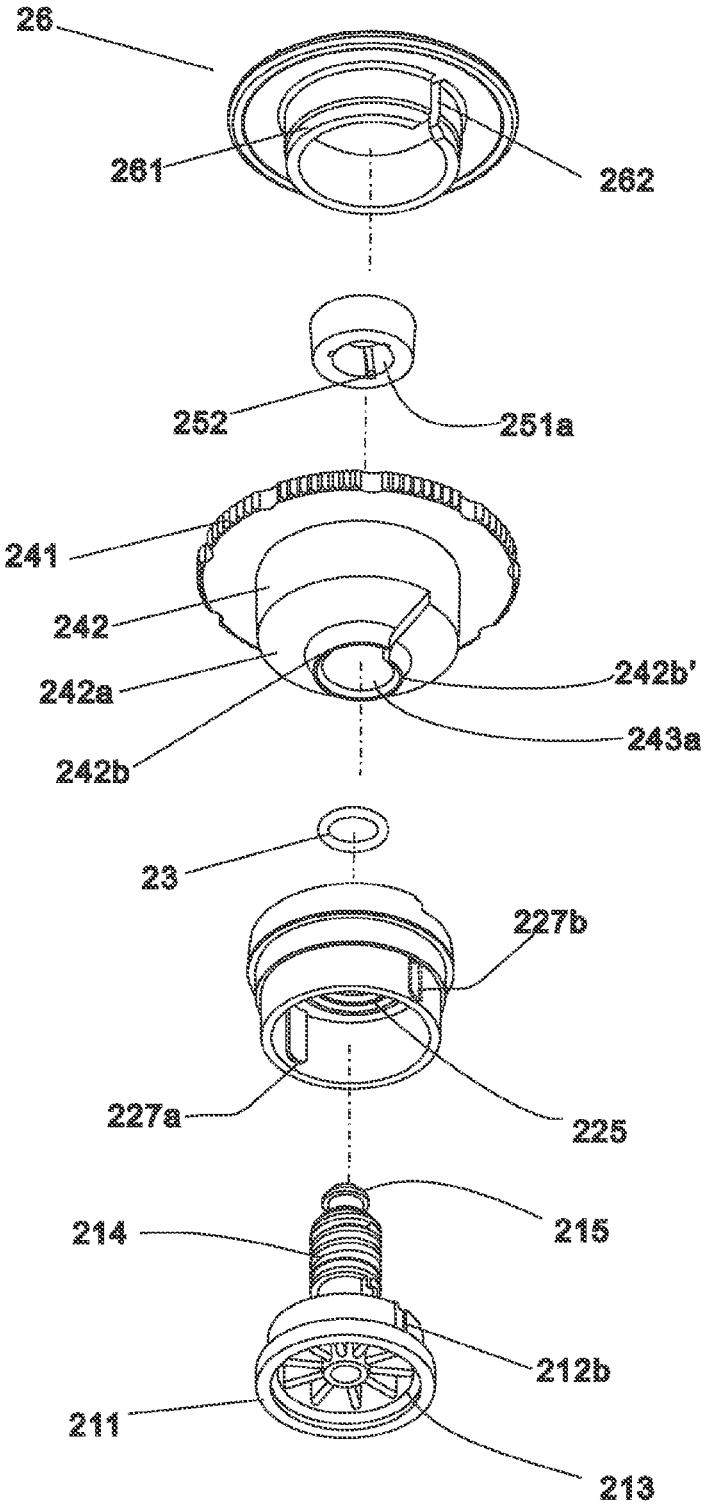
FIG. 2 is another explosive view of a sprinkler head of an embodiment according to the present invention.
Figure 3:
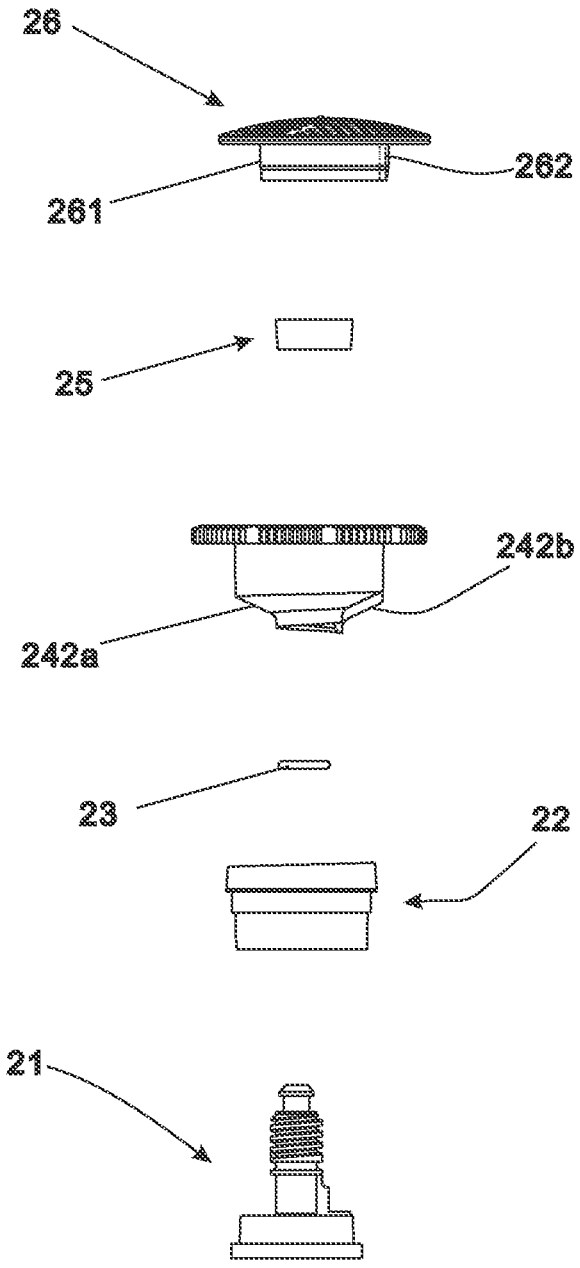
FIG. 3 is a side exploded view of a sprinkler head of an embodiment according to the present invention.

As shown in FIG. 1, FIG. 2 and FIG. 3, the sprinkler head 2 consists of a base seat 21, a collar member 22, a third seal ring 23, an adjustment member 24, a fastener 25, and a cap 26.

The base seat 21 includes an enlarged portion 211, a threaded portion 214 and a plurality of water channels 213. The enlarged portion 211 is extended to form a step portion 212. The step portion 212 is arranged with a first stopping slot 212*a* and a second stopping slot 212*b*. The step portion 212 is further extended to form the threaded portion 214 and a circular groove 214*a*. A mounting portion 215 is disposed on a rear end of the threaded portion 214 while the circular groove 214*a* is enclosed by the third seal ring 23. The threaded portion 214 is mounted into a through hole 243*a* of a leaning part 242 of the adjustment member 24. A plurality of ribs is arranged at certain intervals and extended from the threaded portion 214 inside the step portion 212 so as to form the water channels 213.

The collar member 22 is composed of an upper part 221*a* and a lower part 221*b*. The upper part 221*a* includes a first stopping wall 223, a second stopping wall 224 and a connecting portion 228 between the first stopping wall 223 and the second stopping wall 224. An end surface of the first stopping wall 223 is a conical helical surface 223*a* disposed with a projection portion 223*b*. An end surface of the second stopping wall 224 is also a conical helical surface 224*a* corresponding to the conical helical surface 223*a* of the first stopping wall 223. The first stopping wall 223 is around the collar member 22 while the second stopping wall 224 is arranged inside the first stopping wall 223. One end surface of the second stopping wall 224 is disposed with a lug 224*b* whose shape is an inclined surface and the inclined height thereof is higher than that of the conical helical surface 224*a* of the second stopping wall 224. A first water channel 226*a* and a helical rib 225 are formed due to the second stopping wall 224. The helical rib 225 is wound around an inner diameter of the second stopping wall 224. A groove 228*a* is formed on a bottom surface of the connecting portion 228 of the collar member 22 and the bottom surface of the groove 228*a* is flat.

The adjustment member 24 includes a control part 241, a leaning part 242, an assembly part 243, a concave part 245, a through hole 243*a* and a rib part 245*a*. The leaning part 242 consists of a first against surface 242*a*, a second against surface 242*b* and a third against surface 242*b*'. The leaning part 242 is extended from the control part 241 and the assembly part 243 is arranged with a through hole 243*a* whose inner surface is disposed with internal threads 243*b*. As shown in FIG. 2, the first against surface 242*a* is a conical helical surface while the second against surface 242*b* is a concave conical helical surface. The maximum diameter of the second against surface 242*b* is just matched the diameter of the first water channel 226*a* of the collar member 22. The third against surface 242*b*' is formed by the rear end of the second against surface 242*b*. The water output from first water channel 226*a* can be adjusted or stopped by the against surfaces 242*a*, 242*b*, 242*b*' in combination with the first stopping wall 223, the second stopping wall 224 and the helical rib 225 of the collar member 22. The concave part 245 is formed outside and around the assembly part 243 and the rib part 245*a* is arranged at one side of a circular wall of the concave part 245.

The fastener 25 includes a projecting edge 251 disposed with a plurality of slots 252. Due to the slots 252, a plurality of elastic ribs is formed on the projecting edge 251 and the elastic ribs are arranged circularly to form an insertion hole 251*a*.

The conical helical surface of the first against surface 242*a* is spiral from a lower position to an upper position while the concave conical helical surface of the second against surface 242*b* is spiral from a lower position to an upper position. And the rear end of the second against surface 242*b* forms the third against surface 242*b*' which is a helical surface.

Figure 8:
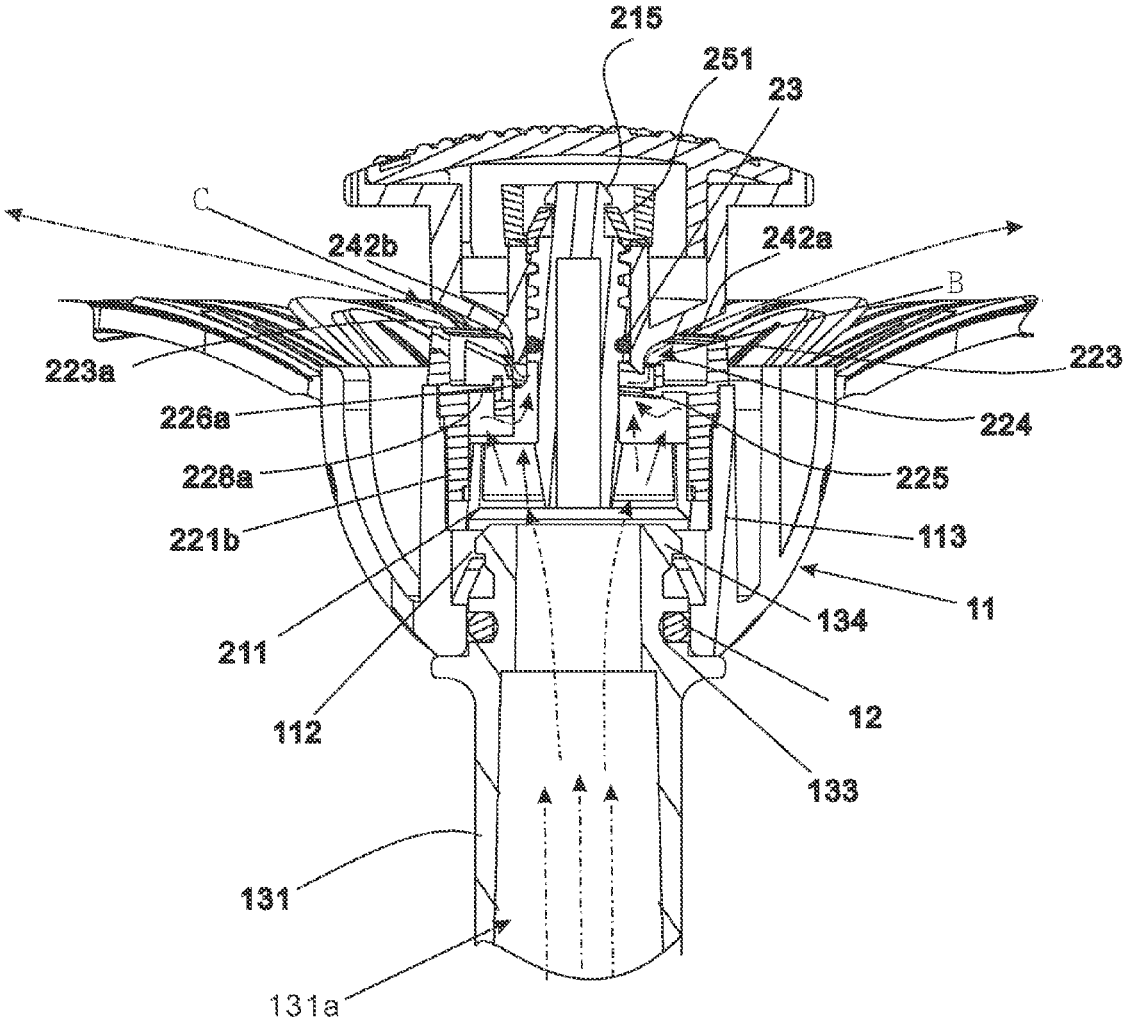
FIG. 8 is a schematic drawing showing a cross sectional view of water outflow of an embodiment according to the present invention.
Figures 1, 8:
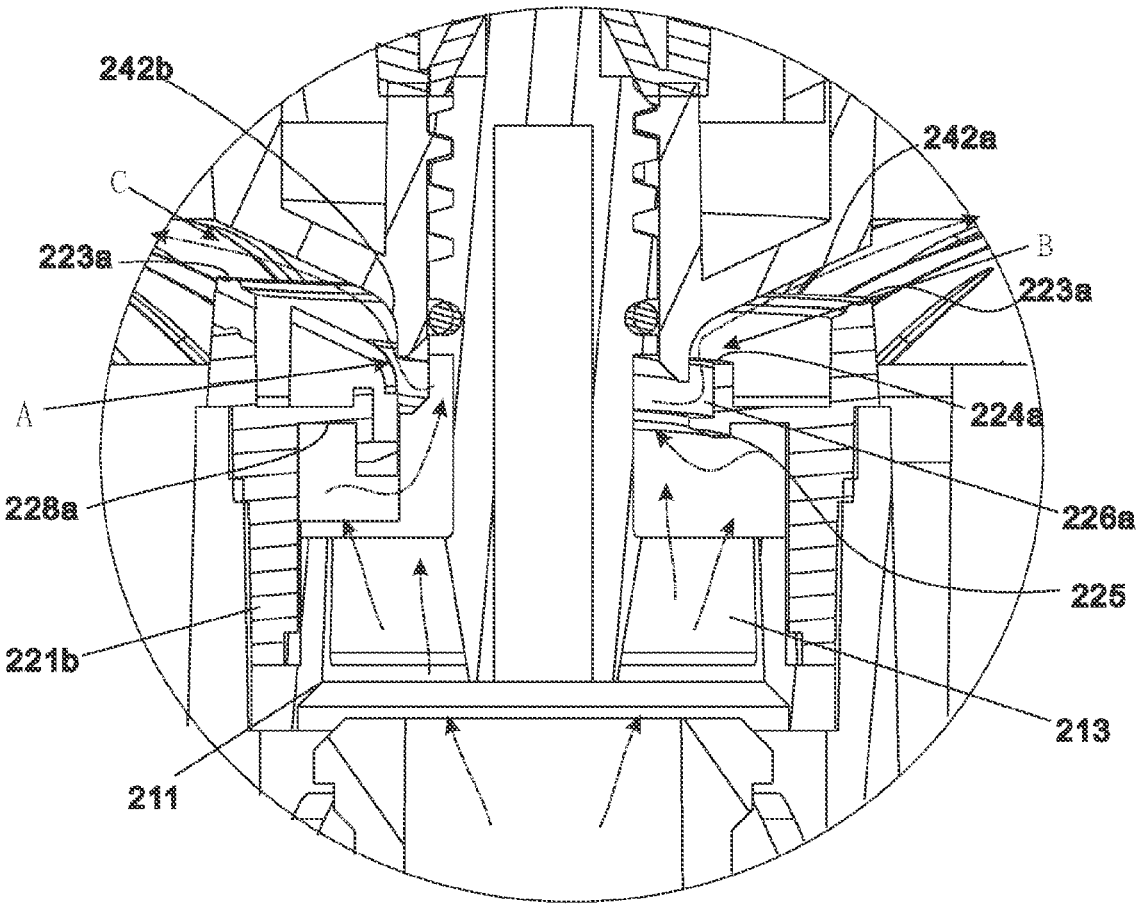

The shape of the first against surface 242*a* and the second against surface 242*b* are matched to the conical helical surfaces 223*a*, 224*a* of the first stopping wall 223 and of the second stopping wall 224 of the collar member 22. As shown in FIG. 8, when the adjustment member 24 is rotated, a second water output gap B and a third water output gap C are formed simultaneously. That means the radial width of the second water output gap B and the third water output gap C is increased or decreased by the adjustment member 24 being rotated so as to change the fan angle of the water sprayed.

Figure 4:
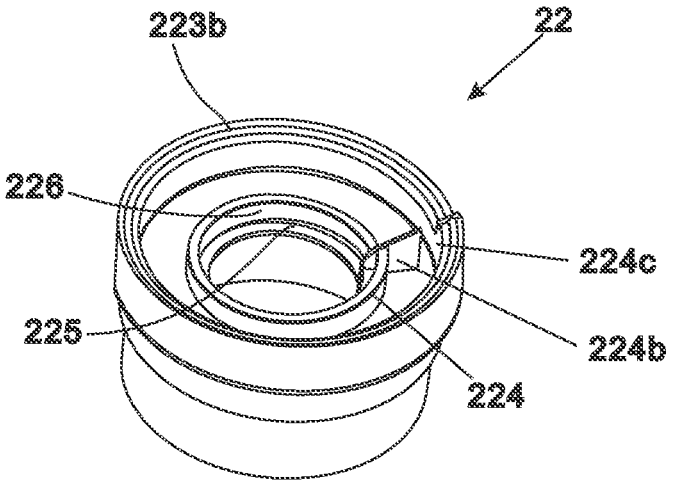
FIG. 4 is a perspective view of a collar member of an embodiment according to the present invention.
Figure 5:
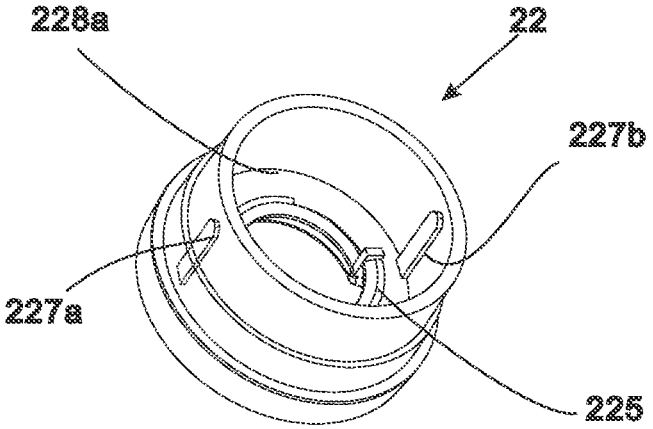
FIG. 5 is another perspective view of a collar member of an embodiment according to the present invention.

As show n in FIG. 4, the second stopping wall 224 includes a tubular wall 226 that forms the first water channel 226*a*. The tubular wall 226 is disposed with the helical rib 225 that is wound around the tubular wall 226. Refer to FIG. 5, a bottom view of the collar member 22 is disclosed. The collar member 22 includes the groove 228*a*, a first projecting rib 227*a* and a second projecting rib 227*b*. The helical rib 225 is wound along the bottom surface of the groove 228*a* and formed spirally on the tubular wall 226.

The sprinkler head 2 is assembled by following steps. Firs pass the threaded portion 214 of the base seat 21 through the second stopping wall 224 of the collar member 22. The mounting portion 215 on one end of the threaded portion 214 is inserted into the through hole 243*a* of the adjustment member 24 and projected out of the assembly part 243 while the threaded portion 214 is engaged with the internal threads 243*b* of the through hole 243*a*. Then the mounting portion 215 is passed through the projecting edge 251 of the fastener 25. Due to elasticity of the projecting edge 251, the diameter of the insertion hole 251*a* of the projecting edge 251 is extended and increased by the mounting portion 215. After the mounting portion 215 being passed through the projecting edge 251, the diameter of the insertion hole 251*a* of the projecting edge 251 turns back to the original length. Thereby the fastener 25 is stopped by the mounting portion 215. The fastener 25 has a larger outer diameter and enables the base seat 21 to be locked with the assembly part 243. Thus the base seat 21 is fixed by and locked with the collar member 22 and the adjustment member 24. That means both the collar member 22 and the adjustment member 24 are mounted between the fastener 25 and the enlarged portion 211 of the base seat 21. At last, a slot portion 262 of the cap 26 is aligned and engaged with the rib part 245*a* of the adjustment member 24. Thus the cap 26 is covered over the concave part 245.

Figure 9:
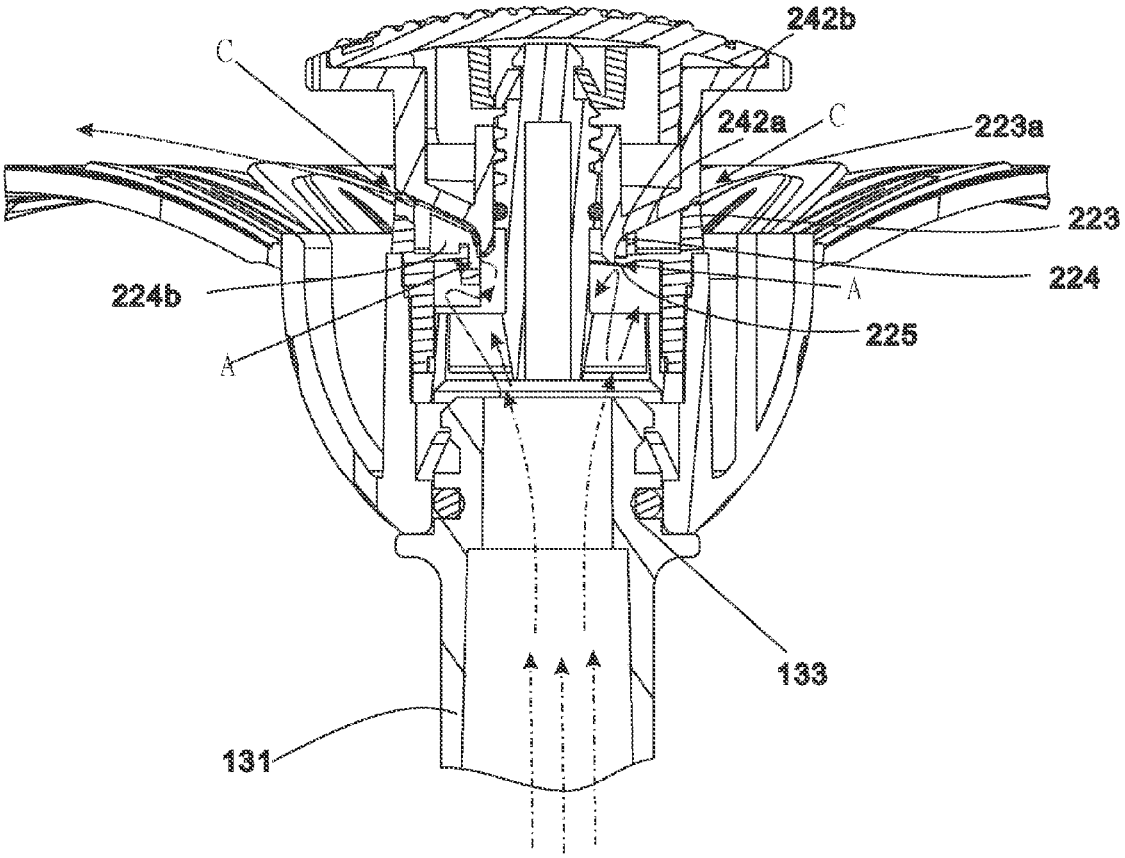
FIG. 9 is another schematic drawing showing a cross sectional view of water outflow of an embodiment according to the present invention.

The fan angle of water flow from the sprinkler head 2 is adjusted by following steps. While rotating the adjustment member 24, a drop is formed between the end point of the helical surface of the first stopping wall 223 of the collar member 22 and the end point of the helical surface of the first against surface 242*a* of the adjustment member 24. The drop is a third outflow gap C. A drop is also formed between the end point of the helical surface of the second stopping wall 224 and the end point of the helical surface of the second against surface 242*b* and this drop is a second outflow gap B. The lug 224*b* is used to stop an opening angle of the second outflow gap B. By rotating the adjustment member 24, the two helical surfaces are gradually away from each other. Thus the second outflow gap B as well as the third outflow gap C is gradually extended and a fan angle spray is formed. As show in FIG. 8 and FIG. 8-1, the maximum fan angle of water outflow is 360 degrees. When the adjustment member 24 is rotated in opposite direction, the helical surface of the second stopping wall 224 and the helical surface of the second against surface 242*b* are gradually getting close to each other. At the same time, the helical surface of the first stopping wall 223 and the helical surface of the first against surface 242*a* are also gradually engaged with each other, even a part thereof is attached closely, as shown in FIG. 9. Thus most of water outflow is stopped and the spray fan angle is getting smaller. The minimum fan angle of water outflow through the e second outflow gap B and third outflow gap C is below 5 degrees. Thus users can adjust the spray fan angle to the degree they need by rotating the adjustment member 24.

For even distribution of the water outflow when the adjustment member 24 is rotated to spray water all-around at 360 degrees, water in a waterway space 131*a* of the base 1 first flows into the water channels 213 of the base seat 21, passes the helical rib 225 and then enters the first water channel 226*a* of the collar member 22 through a first outflow gap A. Next the water passes through the second outflow gap B and finally flows out through the third outflow gap C. The drop formed due to the helical rib 225 and the third against surface 242*b*' in a staggered order shows the open state of the first outflow gap A. Refer to FIG. 8-1, it is obvious that the water flow is distributed evenly twice through the first outflow gap A and the second outflow gap B in turn and then is sprayed out through the third outflow gap C between the first stopping wall 223 and the first against surface 242*a*.

It should be noted that the helical surfaces of the third against surface 242*b*' and the helical rib 225 are corresponding to each other. A drop between the helical rib 225 and the third against surface 242*b*' is gradually generated when the adjustment member 24 is rotated. This drop is the first outflow gap A of the first water channel 226*a*. At the moment, there is also a drop between two corresponding helical surfaces of the second stopping wall 224 and the second against 242*b* of the adjustment member 24. The second outflow gap B is opened or closed by the lug 224*b* leaning against the first against surface 242*a*. In other words, the two corresponding helical surfaces of the helical rib 225 and the third against surface 242*b*' are gradually away from each other by rotating the adjustment member 24 so as to form the first outflow gap A. Thus the water flow is first distributed evenly by the first outflow gap A, through the second outflow gap B and then the third outflow gap C to generated an upward-inclined fan-shaped water spray. The maximum fan angle of the outflow is 360 degrees. As shown in FIG. 9, when the adjustment member 24 is rotated in opposite direction, the two corresponding helical surfaces of the first stopping wall 223 and the first against surface 242*a* are gradually getting closer to each other. At the same time, the two corresponding helical surfaces of the helical rib 225 and the third against surface 242*b*' are almost attached to each other tightly. Thus a large part of the first outflow gap A, the second outflow gap B and the third outflow gap C is closed. Thus the fan-angle of the third outflow gap C is minimized. The minimum fan-angle of the third outflow gap C is below 5 degrees.

The water flow is sprayed out by the sprinkler head 2. The water flow is first dispersed and drained first by the first outflow gap A between the helical rib 225 and the third against surface 242*b*' in a circular way. Moreover, the second against surface 242*b* is concave. This allows the water being sprayed more smoothly. While flowing from the first outflow gap A to the second outflow gap B, the water flow is guided by the concave surface to have second time distribution. At last, the water distributed is sprayed out all around through the third outflow gap C.

The first stopping wall 223 of the collar member 22 is a conical helical surface 223*a* inclined outward and the projection portion 223*b* thereof is also around the conical helical surface 223*a*. The conical helical surface 223*a* of the first stopping wall 223 and the lug 224*b* of the second stopping wall 224 are used as a stopper for the water flow of the connecting portion 228. The first stopping wall 223 can be leaning against the first against surface 242*a* due to the helical structure. More precisely, the projection portion 223 is against the first against surface 242*a*. Due to curved design of the projection portion 223, the water is running out more smoothly. Another point of the present invention is in that the water flows through at least one outflow gap to be dispersed and sprayed. The first one is the first outflow gap A between the helical rib 225 and the third against surface 242*b*'. The next is the second outflow gap B between the second against surface 242*b* and the second stopping wall 224. In the end, the water flow is passed through the third outflow gap C between the first against surface 242*a* and the first stopping wall 223 to be dispersed evenly all around and sprayed out.

In addition, there is an open gap 224*c* formed between the lug 224*b* of the second stopping wall 224 and the first stopping wall 223. The open gap 224*c* is used to release some water pressure in the connecting portion 228. Thus the water flow surrounding is distributed more evenly. The outflow will not have a strong spray at one side while a weak spray at the other side.

As shown in FIG. 6, the assembly of the sprinkler includes the housing 13, the receiving seat 11 and the sprinkler head 2. The housing 13 is tubular and having a threaded portion 135*a*, a hook portion 134 and a first circular concave portion 133. The threaded portion 135*a* is connected to a hose while the hook portion 134 is locked with the receiving seat 11 to form a waterway space 131*a*. circular concave portion One end of the threaded portion 135*a* is disposed with a second circular concave portion 135 while the second circular concave portion 135 is arranged with a second seal ring 14 therearound for being connected to a joint of other irrigation devices (not shown in figure). The first circular concave portion 133 is disposed with a first seal ring 12 therearound.

The receiving seat 11 includes a receiving portion 113 and a fastening portion 112. The receiving portion 113 is tubular and used for mounting the sprinkler head 2 while the fastening portion 112 is arranged at a bottom end of an inner diameter of the receiving portion 113. The fastening portion 112 can be locked with the hook portion 134 so as to connect the housing 13 with the receiving seat 11. As shown in FIG. 2, the cap 26 includes a circular mounting portion 261 and a slot portion 262 arranged at one side of the circular mounting portion 261. The slot portion 262 can be assembled and locked with the rib part 245*a* of the adjustment member 24.

In another embodiment, the lower part 221*b* of the collar portion 22 of the sprinkler head 2 is tightly connected to and fixed on the receiving portion 113 of the receiving seat 11. The sprinkler head 2 is composed of an adjustment member 24, a collar member 22, a base seat 21, and a fastener 25. The adjustment member 24 consists of a control part 241 and a leaning part 242 while the leaning part 242 is formed by a first against surface 242*a* and a second against surface 242*b*. A curved assembly part 243 is extended from the first against surface 242*a* and a rear end of the assembly part 243 forms the second against surface 242*b*. An axis of the control part 241 is extended downward to the leaning part 242 to form a through hole 243*a*. A top end of the through hole 243*a* is disposed with internal threads 243*b*. The threaded portion 214 of the base seat 21 is inserted into the through hole 243*a* of the adjustment member 24 and the threaded portion 214 is engaged with the internal threads 243*b* of the through hole 243*a*.

The assembly between the adjustment member 24 and the base seat 21 is by the threaded portion 214 of the adjustment member 24 being passed through a second stopping wall 224 of the collar member 22 and then engaged with the internal threads 243*b* of the through hole 243*a* of the adjustment member 24. A mounting portion 215 of the base seat 21 is projecting out of the through hole 243*a* and then is fastened with the fastener 25 by being pressed. Thus the assembly of the sprinkler head 2 on the receiving seat 11 is completed.

The sprinkler of the present invention is assembled by following steps. In the beginning, the first circular concave portion 133 of the housing 13 is disposed with the first seal ring 12 therearound. Then the hook portion 134 of the housing 13 is locked with the fastening portion 112 of the receiving seat 11 so as to connect the housing 13 with the receiving seat 11. Next the lower part 221*b* of the collar portion 22 of the sprinkler head 2 is connected to the receiving portion 113 of the receiving seat 11 by ultrasonic bonding and is tightly attached to an upper edge of the fastening portion 112. The first projecting rib 227*a* and the second projecting rib 227*b* on the lower part 221*b* of the collar member 22 should be aligned with a first stopping slot 212*a* and a second stopping slot 212*b* of the base seat 21 to be assembled with each other. The threaded portion 214 of the adjustment member 24 is passed through a second stopping wall 224 of the collar member 22.

Figure 10:
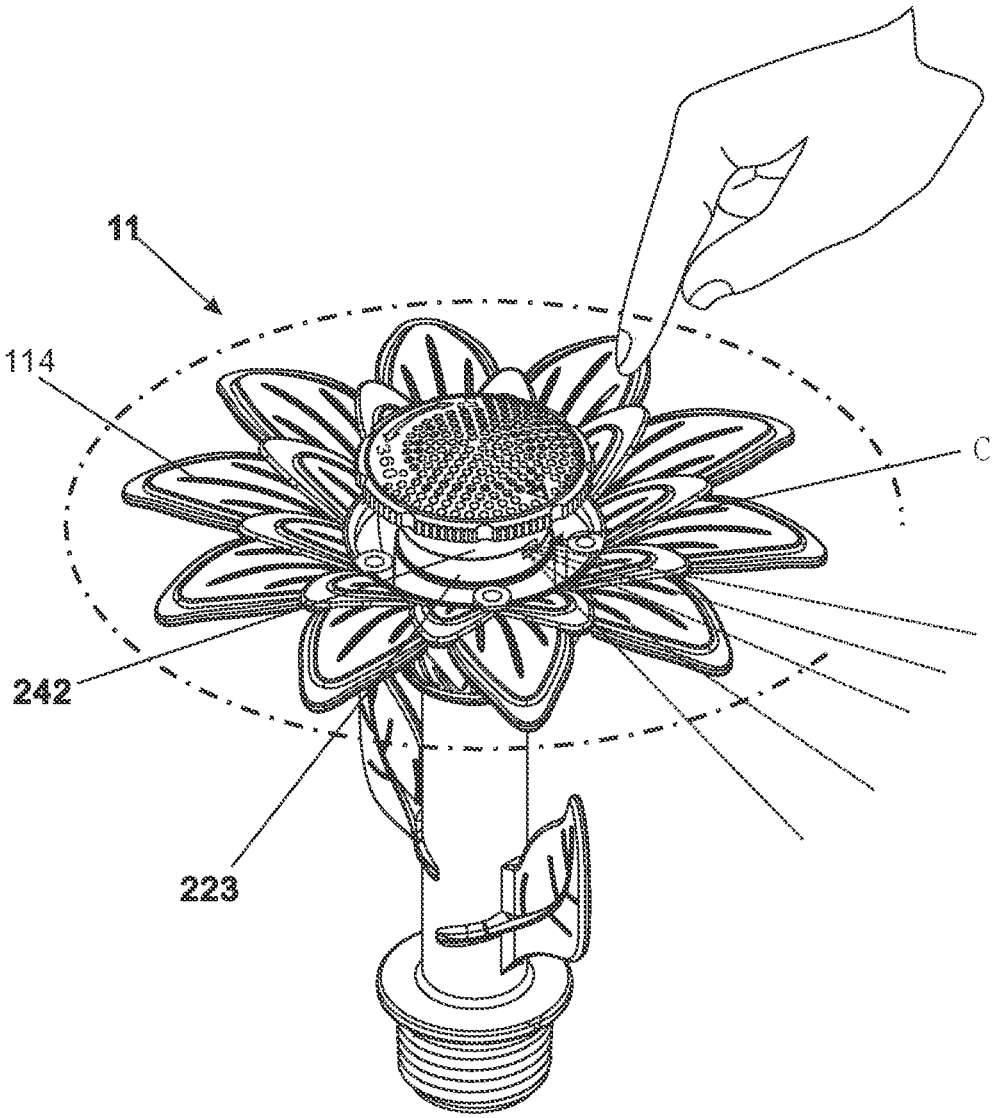
FIG. 10 is a schematic drawing showing another embodiment in use according to the present invention.

Then the threaded portion 214 of the adjustment member 24 is engaged with the internal threads 243*b* of the through hole 243*a* of the adjustment member 24. At last, the slot portion 262 of the cap 26 is assembled and locked with the rib part 245*a* of the adjustment member 24. The assembly of the sprinkler is completed. Refer to FIG. 8, the housing 13 and the receiving seat 11 are assembled by the first circular concave portion 133 of the housing 13 being disposed with the first seal ring 12 therearound first and then the hook portion 134 of the housing 13 being locked with the fastening portion 112 of the receiving seat 11. Yet a top end of the hook portion 134 is leaning against a bottom end of the base seat 21 of the sprinkler head 2 and the lower part 221*b* of the collar member 22 is adhered to the receiving portion 113 of the receiving seat 11, as shown in FIG. 10. Such design enables the receiving seat 11 to be rotatable on top of a tubular body 131 of the housing 13.

In addition, a pushed portion 114 is extended from and formed on the receiving seat 11. In this embodiment, the spray direction can be adjusted by the pushed portion 114 extended from the receiving seat 11. The operation mode is shown in FIG. 10. A user only needs to rotate the pushed portion 114 by the hand. The spray direction of the sprinkler head 2 is also rotated. For example, if the user set the spray fan angle of the sprinkler head 2 is ranging from 5 to 15 degrees. After being settled, the water sprayed is toward one direction. Then the spray direction is adjusted by rotating the pushed portion 114. When the spray is applied by the sprinkler head 2 toward the east but the user intends to apply the spray toward the west, the user only needs to rotate the pushed portion 114 and the direction of the sprinkler head 2 is changed to the west. There is no need to rotate the adjustment member 24 for changing the spray angle.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A sprinkler used for irrigation comprising a base having a receiving seat and a housing; and a sprinkler head disposed over the base for adjusting fan angle of outflow; wherein the sprinkler head is connected to the receiving seat and including a base seat having an enlarged portion and a threaded portion extended from the enlarged portion; a collar member having an upper part and a lower part; the upper part of the collar member includes a tubular wall that is disposed with a helical rib; the helical rib is wound around the tubular wall, from a lower position to a higher position; and an adjustment member having a control part, a leaning part, an assembly part and a through hole; the leaning part includes a first against surface, a second against surface and a third against surface; the first against surface is a helical conical surface, the second against surface is a concave helical conical surface and the third against surface is a helical surface; wherein the threaded portion of the base seat is passed through the tubular wall of the collar member and then is engaged with the assembly part of the adjustment member so as to complete assembly of the sprinkler head.

2. The device as claimed in claim 1, wherein the upper part is arranged with a first stopping wall and a second stopping wall arranged inside said first stopping wall; an end surface of the first stopping wall is a conical helical surface disposed with a projection portion; an end surface of the second stopping wall is a conical helical surface corresponding to the conical helical surface of the first stopping wall; the first against surface and the second against surface of the adjustment member are conical helical surfaces matched to the first stopping wall and the second stopping wall of the collar member; the two helical surfaces of the first against surface and the first stopping wall are gradually away from each other by rotating the adjustment member so as to form a third outflow gap; the two helical surfaces of the second against surface and the second stopping wall are gradually away from each other by rotating the adjustment member so as to form a second outflow gap; the helical rib and the third against surface are helical surfaces corresponding to each other; the helical surfaces are gradually away from each other by rotating the adjustment member so as to form a first outflow gap.

3. The device as claimed in claim 2, wherein water to be sprayed by the sprinkler head is passed through the first outflow gap between the helical rib and the third against surface, and then passed through the second outflow gap between the second against surface and the second stopping wall, and finally is dispersed evenly by the third outflow gap.

4. The device as claimed in claim 3, wherein a connecting portion is arranged between the first stopping wall and the second stopping wall; a groove is formed on a bottom surface of the connecting portion and a bottom surface of the groove is flat; and the conical helical surface of the first stopping wall is disposed with a projection portion.

5. The device as claimed in claim 3, wherein the conical helical surface of the first stopping wall and the conical helical surface of the second stopping wall are inclined at an angle.

6. The device as claimed in claim 1, wherein the receiving seat includes a tubular receiving portion used for mounting the sprinkler head and a fastening portion arranged at a bottom end of an inner diameter thereof; wherein the housing is disposed with a circular concave portion and a hook portion; the circular concave portion is arranged with a seal ring therearound and then the hook portion of the housing is locked with the fastening portion of the receiving seat so as to connect the housing with the receiving seat.

7. The device as claimed in claim 1, wherein the lower part of the collar member is connected to the receiving portion of the receiving seat by ultrasonic bonding.

8. The device as claimed in claim 1, wherein a pushed portion is extended from the receiving seat and is used for adjusting spray direction of the sprinkler.

9. The device as claimed in claim 1, wherein the enlarged portion of the base seat is extended to form a step portion; the step portion is arranged with a first stopping slot and a second stopping slot.

10. The device as claimed in claim 9, wherein the step portion is extended to form a threaded portion and a circular groove; a mounting portion is disposed on a rear end of the threaded portion and the circular groove is enclosed by a seal ring.

11. The device as claimed in claim 1, wherein a concave part is formed by an external diameter of the assembly part of the adjustment member and a rib part is arranged at one side of a circular wall of the concave part.

12. The device as claimed in claim 1, wherein one end of the threaded portion is disposed with a mounting portion.

13. A sprinkler used for irrigation comprising: a base and a sprinkler head disposed over the base for adjusting fan angle of outflow; wherein the sprinkler head includes a base seat, a collar member, a seal ring and an adjustment member; the base seat having an enlarged portion, a threaded portion extended from the enlarged portion and a mounting portion disposed on a rear end of the threaded portion; the collar member having an upper part and a lower part; wherein the upper part of the collar member includes a tubular wall and the tubular wall is disposed with a helical rib; the helical rib is wound around the tubular wall, spiraling from a bottom surface of the tubular wall to a higher position; the adjustment member having a control part, a leaning part, an assembly part and a through hole; the leaning part includes a first against surface and a second against surface; the first against surface is a helical conical surface while the second against surface is a concave helical conical surface; one end of the threaded portion of the base seat enclosed by a seal ring is passed through the second stopping wall of the collar member and then is engaged with internal threads of the through hole of the adjustment member; the mounting portion of the threaded portion is projecting out of the through hole and then is fastened with a fastener to form the sprinkler head.

14. The device as claimed in claim 13, wherein the fastener includes a projecting edge and the projecting edge is disposed with a plurality of slots; wherein a plurality of elastic ribs is formed on the projecting edge due to arrangement of the slots.

15. A sprinkler used for irrigation comprising a base and a sprinkler head disposed over the base for adjusting fan angle of outflow; wherein the sprinkler head includes a base seat, a collar member, a seal ring and an adjustment member; the base seat having an enlarged portion, a threaded portion extended from the enlarged portion and a mounting portion disposed on a rear end of the threaded portion; the collar member having an upper part and a lower part; the upper part of the collar member includes a tubular wall that is disposed with a helical rib; the helical rib is wound around the tubular wall, spiraling from a bottom surface of the tubular wall to a higher position; the adjustment member having a control part, a leaning part, an assembly part and a through hole; the leaning part includes a first against surface, a second against surface and a third against surface; the first against surface is a helical conical surface, the second against surface is a concave helical conical surface and the third against surface is a helical surface; wherein one end of the threaded portion of the base seat enclosed by a seal ring is passed through the second stopping wall of the collar member, the tubular wall of the collar member and then is engaged with internal threads of the through hole of the adjustment member so as to form the sprinkler head.

16. The device as claimed in claim 15, wherein the base includes a receiving seat, a housing and a seal ring; the receiving seat includes a pushed portion extended therefrom, a fastening portion and a tubular receiving portion while the housing is disposed with a hook portion and a circular concave portion; wherein for assembling the receiving seat with the housing, the circular concave portion of the housing is arranged with a seal ring therearound and then the hook portion of the housing is locked with the receiving seat while a top end of the hook portion is leaning against a bottom end of the base seat and the lower part of the collar member is adhered to the receiving portion of the receiving seat.

17. The device as claimed in claim 15, wherein the collar member includes a first projecting rib and a second projecting rib.

18. The device as claimed in claim 15, wherein the base seat is arranged with a first stopping slot and a second stopping slot; the base seat and the collar member are assembled by the first projecting rib and the second projecting rib of the collar member being aligned with and mounted into the first stopping slot and the second stopping slot of the base seat respectively.

19. The device as claimed in claim 15, wherein the adjustment member is covered by a cap; wherein the cap includes a slot portion and the slot portion is aligned with the rib part of the adjustment member and then the cap is covered over a concave part of the adjustment member.

20. The device as claimed in claim 15, wherein the upper part is arranged with a first stopping wall and a second stopping wall arranged inside said first stopping wall; an end surface of the first stopping wall is a conical helical surface disposed with a projection portion; an end surface of the second stopping wall is also a conical helical surface corresponding to the conical helical surface of the first stopping wall; the first against surface and the second against surface of the adjustment member are conical helical surfaces matched to the first stopping wall and the second stopping wall of the collar member; the two helical surfaces of the first against surface and the first stopping wall are gradually away from each other by rotating the adjustment member so as to form a third outflow gap; the two helical surfaces of the second against surface and the second stopping wall are gradually away from each other by rotating the adjustment member so as to form a second outflow gap; and the helical rib and the third against surface are helical surfaces corresponding to each other; the helical surfaces are gradually away from each other by rotating the adjustment member so as to form a first outflow gap.

21. The device as claimed in claim 20, wherein water to be sprayed by the sprinkler head is passed through the first outflow gap between the helical rib and the third against surface, and then passed through the second outflow gap between the second against surface and the second stopping wall, and finally is dispersed evenly by the third outflow gap.

* * * * *